US006971711B1

(12) United States Patent
Gast

(10) Patent No.: US 6,971,711 B1
(45) Date of Patent: Dec. 6, 2005

(54) STOOL FOR A CLOSET

(76) Inventor: Arnold Gast, 268 Ladue Lake Dr., Creve Coeur, MO (US) 63141

( * ) Notice: Subject to any disclaimer, the term of this patent is extended or adjusted under 35 U.S.C. 154(b) by 0 days.

(21) Appl. No.: 11/018,782

(22) Filed: Dec. 21, 2004

(51) Int. Cl.[7] ..... A47C 9/06
(52) U.S. Cl. ..... 297/14; 297/333; 297/332
(58) Field of Search ..... 297/331, 332, 297/335, 14, 452.39, 311, 337, 333; 248/284.1, 248/291.1, 165, 166; 4/578.1

(56) References Cited

U.S. PATENT DOCUMENTS 372,841 A * 11/1887 Danner ..... 297/331
874,082 A * 12/1907 Joergensen ..... 248/596
969,347 A * 9/1910 Davis ..... 297/311
2,387,451 A * 10/1945 Kuntz ..... 297/452.1
2,658,553 A * 11/1953 Stewart ..... 297/243
5,335,970 A * 8/1994 Bryant et al. ..... 297/344.22
5,673,968 A * 10/1997 Ponzio ..... 297/143
5,950,256 A * 9/1999 Slater ..... 4/579

* cited by examiner

*Primary Examiner*—Milton Nelson, Jr.
(74) *Attorney, Agent, or Firm*—Polster, Lieder, Woodruff & Lucchesi, L.C.

(57) ABSTRACT

A stool is provided for placement in a closet and which may be selectively extended or stored away. The stool comprises a horizontal support and a seat rotatably attached to the horizontal support. A first leg is attached to the horizontal support, and a swing arm is rotatably attached to the horizontal support. A second leg is attached to the swing arm at an end opposite from the horizontal support. A mounting flange pivotally connects the horizontal support to a closet partition or wall. The three pivot points (i.e., the seat, the swing arm, and the horizontal support) allow for the stool to be selectively moved between a storage position in which the stool is stored in the closet and a use position.

16 Claims, 5 Drawing Sheets

STOOL FOR A CLOSET

FIELD OF THE INVENTION

The invention relates to stools. More specifically, the invention relates to a stool for a closet that can be extended for seating or folded away for storage.

BACKGROUND OF THE INVENTION

Walk-in and other types of closets for the storage of clothing and personal items have greatly increased in popularity. These closets afford more room to store items and in which to walk. Additionally, people have begun to furnish large closets with elaborate shelving for shoes, shirts, sweaters, etc., drawers for socks, under garments and other clothing, and storage systems. As a result, people spend more time in their closets selecting clothing and even using the area as a dressing room. The closet areas are generally not so expansive as to allow seating to be permanently placed within the room. However, because people spend an increasing amount of time performing their daily dressing tasks, people have a desire for seating within their walk-in closets.

As a result, there is a need for seating for a walk-in closet that does not permanently occupy floor space within the closet.

SUMMARY OF THE INVENTION

The present invention comprises a stool for placement in a closet that may be selectively extended or stored away. The stool comprises a horizontal support and a seat rotatably attached to the horizontal support. A first leg is attached to the horizontal support, and a swing arm having a second leg attached at one end thereof is rotatably attached to the horizontal support at an opposite end thereof. A flange is rotatably attached to the horizontal support at an opposite end of the horizontal support from the first leg. The flange is attachable to a partition such that the partition provides support for the stool and a user seated on the stool when in an extended position and allows the support, seat and legs of the stool to be rotated to a stored position adjacent the partition.

DESCRIPTION OF THE PREFERRED EMBODIMENT

Figure 1:
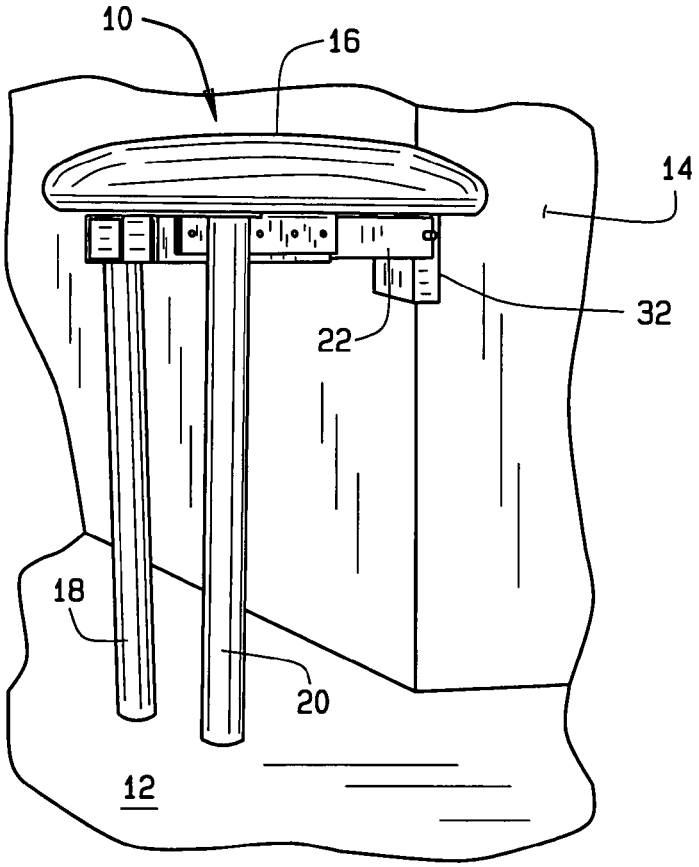
FIG. 1 is perspective view of a stool according to an embodiment of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

As shown in FIG. 1, the present invention comprises a stool 10 for a closet area 12 and which may be attached to a wall or partition 14 of the closet 12. The stool comprises a seat 16, first and second legs 18, 20 and a horizontal support 22.

Figure 2:
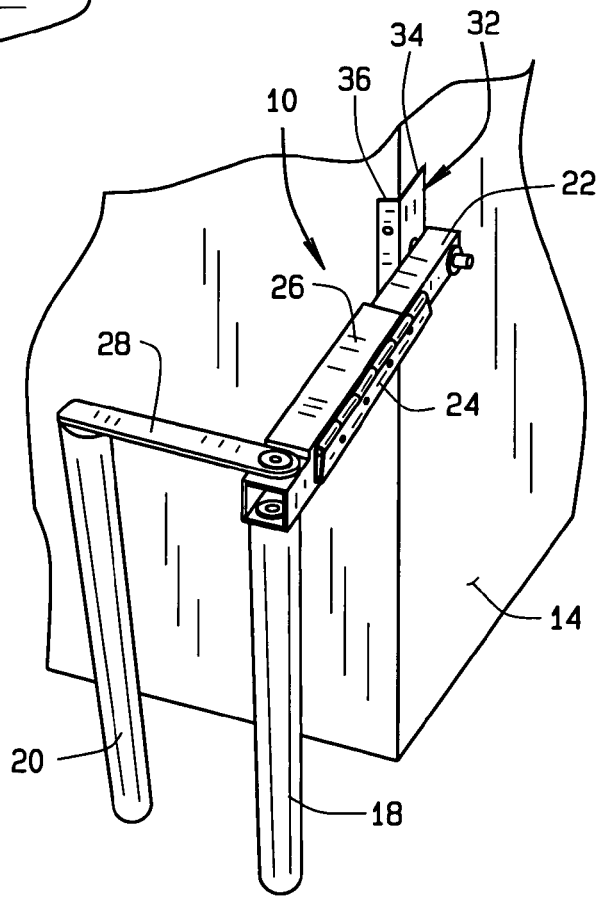
FIG. 2 is another perspective view of a stool according to an embodiment of the present invention having the seat removed.

Referring to FIG. 2, the stool 10 is shown without the seat 16. As can be seen from FIG. 2, a hinge 24 is attached to the horizontal support 22 by one leaf of the hinge. A second leaf of the hinge is attachable at to the seat 16. The preferred hinge 24 is a spring-loaded piano hinge that is spring biased into a closed position, as shown in FIG. 2. Also attached to the top surface of the support 22 is a seat support plate 26 upon which the seat 16 may rest. The first leg 18 is attached to a bottom surface of the support 22 and a swing arm 28 is rotatably attached to the top surface of the horizontal support 22. The swing arm 28 can pivot from a storage position in which it is generally co-linear with the horizontal support 22 to a support position in which the swing arm 28 is substantially perpendicular to the support 22. The seat support plate 26 is slightly wider than the swing arm 28, such that the top surface of the support plate 26 is slightly higher than the top surface of the swing arm 28. This slight difference in height substantially reduces the possibility of the swing arm from wiping against the bottom of the seat when the stool is moved to a use position, and hence facilitates pivoting of the swing arm from a storage poison to a supporting or use position. The support plate 26 also acts as a stop for the swing arm 28 such that the swing arm 28 can rotate from the position shown in FIG. 2 to a position that is 180 degrees about the first leg 18. The second leg 20 is attached to the swing arm 28 at the free end of the swing arm and extends downwardly from the swing arm 28.

Figure 3:
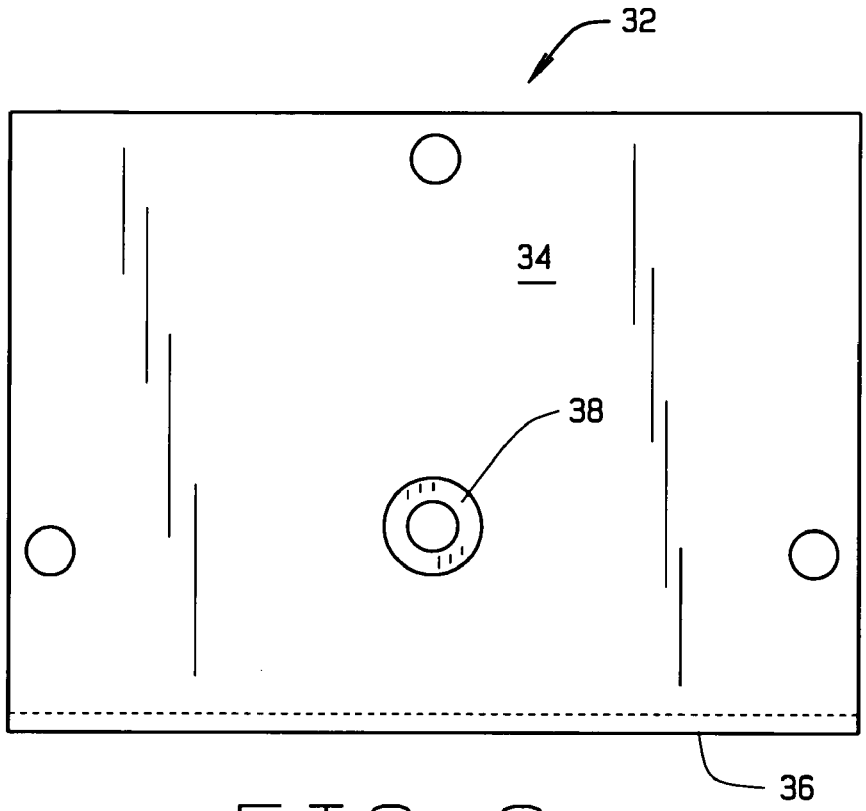
FIG. 3 is a front plan view of a mounting flange for a stool according to an embodiment of the present invention.
Figure 4:
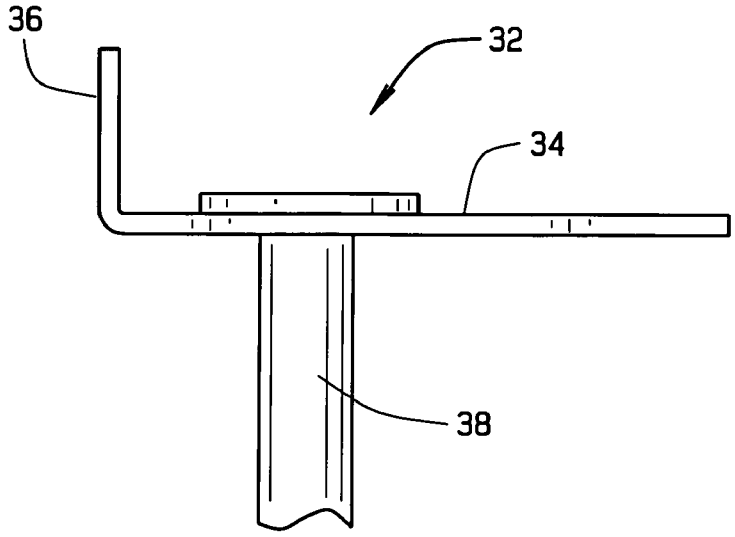
FIG. 4 is a side plan view of a mounting flange for a stool according to an embodiment of the present invention.
Figure 5:
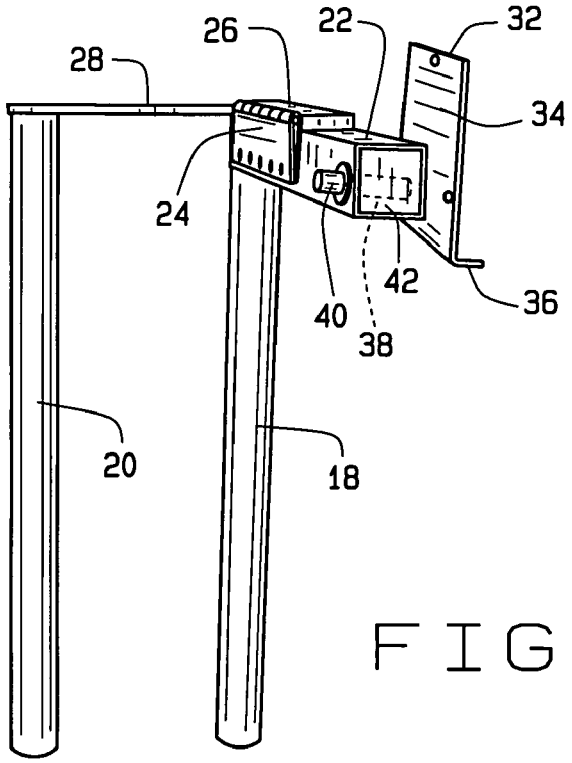
FIG. 5 is perspective view opposite that of FIG. 2 of a stool according to an embodiment of the present invention.

A mounting flange 32 is provided at the end of the horizontal support 22 opposite the swing arm 28. The mounting flange 32 is adapted to be connected to a closet partition 14 to mount the stool 10 to the closet. Therefore, as can be seen in FIG. 2, the legs 18, 20 together with the partition 14 provide support for a person seated upon the stool 10. The seat 16 is substantially centered over the swing arm 28, and hence the legs 18 and 20 provide substantially all the support for the seat 16. Thus, substantially no vertical forces are applied to the connection of the flange 32 to the partition when the seat is in use. Referring to FIGS. 3 and 4, the mounting flange 32 comprises a flat portion 34 having a lip 36 extending 90 degrees therefrom. The lip 36 has a width approximately equal to the width of the partition to which the flange is to be connected. Screw holes are provided in both the lip 36 and the flat portion 34. Hence, the flange is connected or mounted to the partition 14 along the front edge of the partition and along the side surface of the partition. A dowel 38 extends perpendicularly from the flat portion 34. As seen in FIG. 5, the mounting flange dowel 38 passes through aligned openings in the opposite sides of the horizontal support 22. The dowel 38 can be provided with an internally threaded bore at its free end. A fastener 40 (such as a bolt) is threaded into the dowel bore to secure the horizontally support 22 to the mounting flange 32. The dowel 38 is sized to allow the horizontal support 22 to pivot about the dowel 38. The opposite ends of the horizontal support 22 can be closed with end caps 42 if the support 22 is made from a hollow stock material.

Although the dowel 38 is shown and described to have an internally threaded bore at its free end which receives the fastener 40, the dowel could, alternatively, have an externally threaded shaft which receives the fastener. In this instance, the fastener would be in the form of a nut.

Figure 6A:
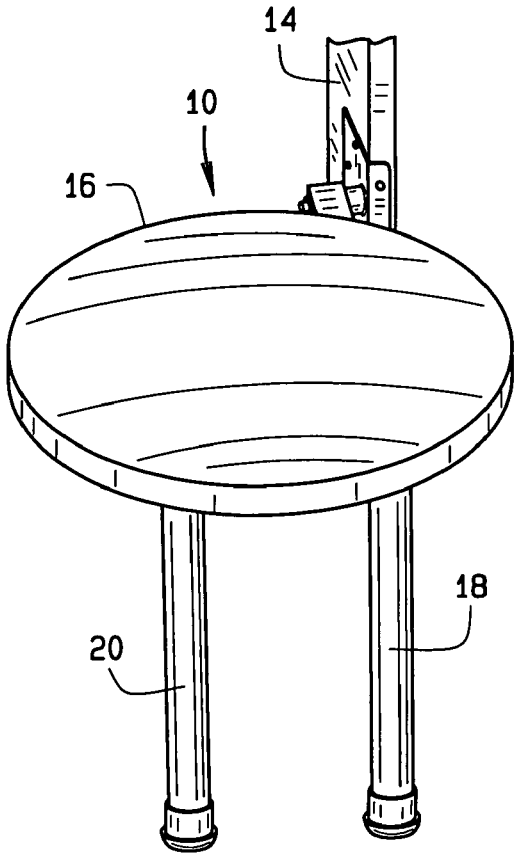
FIG. 6A is front perspective view of a stool in an extended position according to an embodiment of the present invention.
Figure 6B:
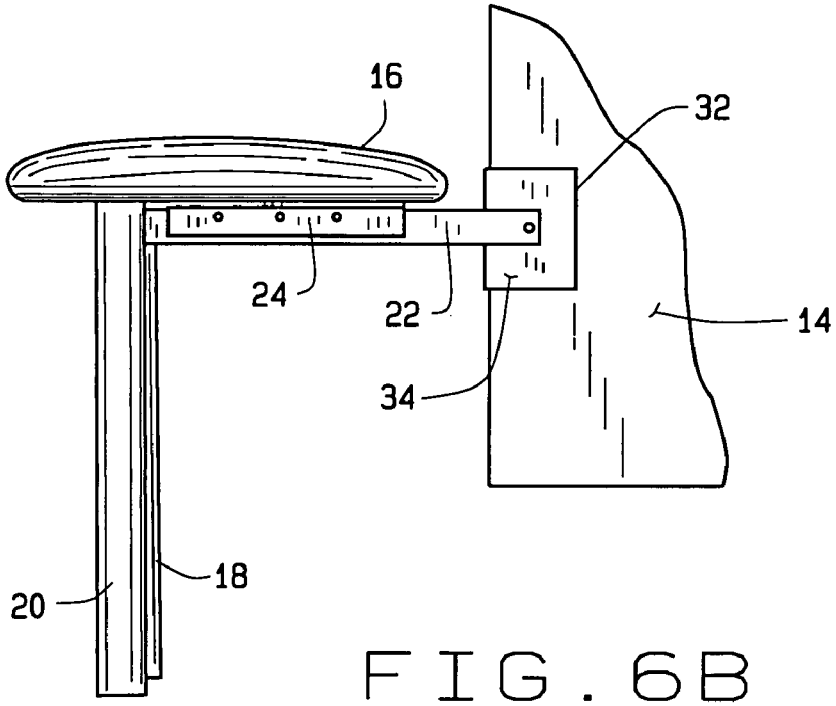
FIG. 6B is side perspective view of a stool in an extended position according to an embodiment of the present invention.
Figure 7:
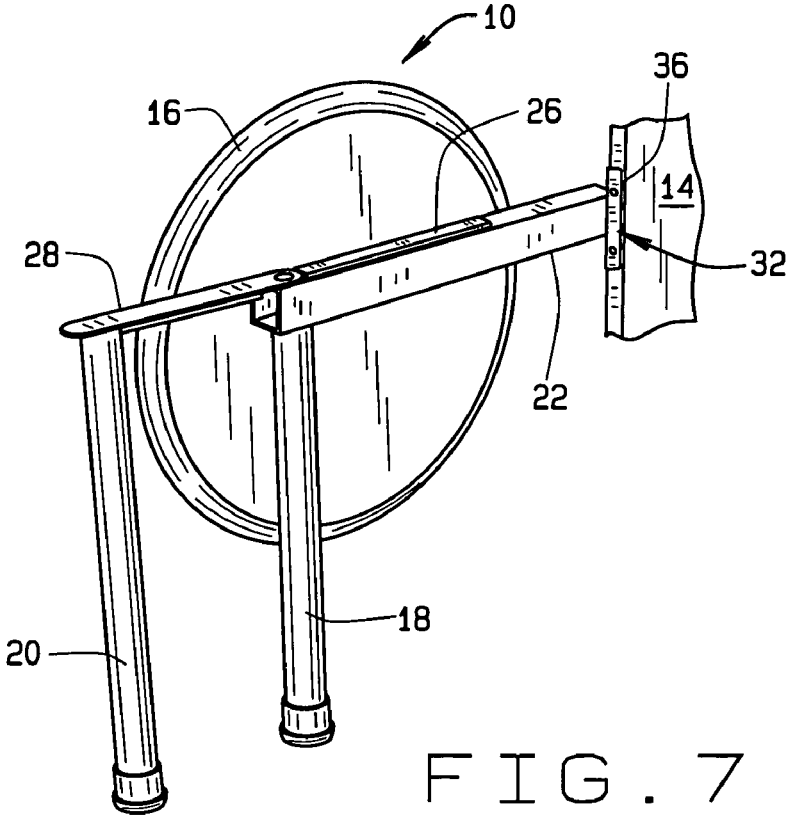
FIG. 7 is perspective view of a stool with a seat in a vertical position and swing arm rotated to be collinear with a horizontal support of the stool according to an embodiment of the present invention.
Figure 8:
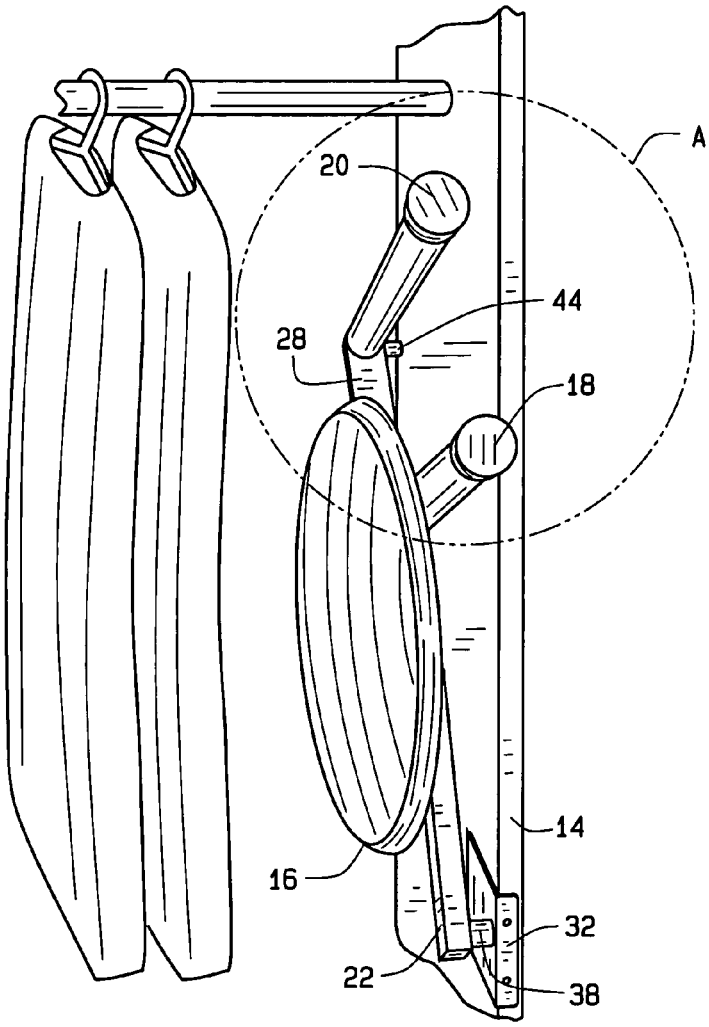
FIG. 8 is perspective view of a stool in a storage position according to an embodiment of the present invention.
Figure 9:
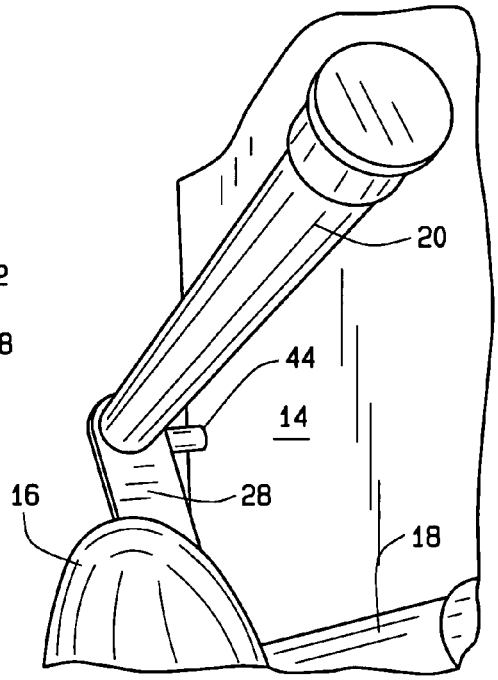
FIG. 9 is an enlarged view of the area A of FIG. 8.

The stool 10 is be operated (to be moved from an open or "use" position to a storage position) as shown in FIGS. 6A–8. In FIGS. 6A and 6B, the seat 16 of the stool 10 is placed such that it is supported by the swing arm 28 and the support plate 26. In this position one may safely sit on the seat 16, as it is supported by the two legs 18, 20. As noted above, substantially all a user's weight will be borne by the legs 18 and 20. Hence, the horizontal support 22 and the partition 14 will form a third "leg" for the stool. However, substantially no load will be applied against the connection between the flange 32 and the partition 14. This will reduce the possibility of the flange being pulled out of the partition. To place the stool 10 in a storage position, the swing arm 28 is rotated 90 degrees to the position shown in FIG. 7. This allows the seat 16 to be rotated to the position shown in FIG. 7, as the swing arm 28 no longer supports the seat 16. The spring mounted hinge will automatically move the seat from the horizontal position seen in FIGS. 6A, B to the generally vertical position seen in FIG. 7. Next, the legs 18, 20, seat 16 and support arm 22 are rotated about the dowel 38 of the mounting flange 32 (which is attached to the partition 14). In this manner, the stool 10 is stored closely to the partition 14 and out the way of the user. FIG. 9 is an enlargement of the circle A of FIG. 8. In FIG. 9, it can be seen that a pin 44 has been inserted into the partition 14 to provide a stop for the stool 10 when the stool 10 is in the stored position. This pin 44 is preferably positioned so as to prevent the end of the swing arm 28 from hitting (and thus marring) the back wall of the closet. In the stored position, the stool has a width of about 4". Thus, as can be appreciated, the stool can be placed in a closet and will take up very little space in the closet. In fact, the stool can be placed in a clothing storage area of the closet (i.e., a portion of the closet in which clothes hang from a bar), and the clothes would simply hang next to the stool 10. As seen in FIG. 8, the clothes would contact the stool seat 16, and hence, would not be dirtied by the stool hinge or the bottom side of the seat 16.

While the several views of the Figures show the stool attached to the left side of a partition, it will be understood by one of ordinary skill in the art from the present disclosure that if the swing arm were rotated 180 degrees from the view of FIG. 6A, for example, and the hinge 24 located on the right side of the support, the stool would be properly configured to be attached to the right side of a partition wall 14.

While the specific embodiments have been illustrated and described, numerous modifications come to mind without significantly departing from the spirit of the invention, and the scope of protection is only limited by the scope of the accompanying claims.

What is claimed is:

1. A stool for placement in a closet and which may be selectively moved between a use position and a storage position, the stool comprising:

a horizontal support;

a seat rotatably attached to the horizontal support, and being movable relative to the support between a use position and a storage position;

a swing arm pivotally attached to the horizontal support at one end thereof; the swing arm being pivotal between a storage position and a use position;

a first leg attached to the horizontal support and a second leg attached to the swing arm;

a mounting flange adapted to be secured to a closet partition; the horizontal support being pivotally connected to the mounting flange to be movable between a use position and a storage position.

2. The stool of claim 1 further comprising a support plate for supporting the seat and for providing a stop for the swing arm.

3. The stool of claim 2 wherein the support plate has a width, such that an upper surface of the support plate is vertically spaced above an upper surface of the swing arm when the stool is in a use position.

4. The stool of claim 1 wherein the seat is rotatably attached to the horizontal support by a hinge.

5. The stool of claim 4 wherein the hinge is a spring loaded piano hinge that biases the seat to the storage position.

6. The stool of claim 1 wherein the swing arm is attached to a top surface of the horizontal support.

7. The stool of claim 1 wherein the mounting flange comprises a flat portion having a lip extending 90 degrees therefrom.

8. The stool of claim 7 wherein the mounting flange comprises a dowel that extends substantially perpendicularly from the flat portion, the dowel extending through said horizontal support to define a pivot point for the horizontal support.

9. The stool of claim 8 wherein the dowel is adapted to receive a fastener at a free end thereof to maintain the connection of the horizontal support to the dowel.

10. A stool comprising:

a horizontal support;

a seat pivotally connected to the horizontal support by a hinge to be movable between a storage position and a use position; the hinge being biased to urge the seat to the storage position;

a first leg attached to the horizontal support;

a swing arm having a second leg attached at one end thereof; the swing arm being rotatably attached to the support at an end of said swing arm opposite said second leg;

a flange rotatably attached to the horizontal support at an opposite end of the horizontal support from the first leg, the flange being attached to the horizontal support by a dowel that extends from the flange and through the horizontal support; the flange being adapted to be connected to a wall of a closet.

11. The stool of claim 10 further comprising a support plate for supporting the seat; the support plate having an upper surface spaced vertically above an upper surface of said swing arm when said swing arm is in its use position.

12. The stool of claim 10 wherein the swing arm is attached to a top surface of the horizontal support.

13. The stool of claim 10 wherein the flange comprises a flat portion having a lip extending 90 degrees therefrom.

14. The stool of claim 10 wherein the dowel is adapted to receive a fastener to secure the horizontal support to the dowel.

15. The stool of claim 14 wherein the dowel includes an internally threaded bore at its free end, said fastener comprising a bolt.

16. The stool of claim 14 wherein the dowel includes an externally threaded shaft; said fastener comprising a nut.

* * * * *